United States Patent [19]

Devendra

[11] Patent Number: 4,836,268

[45] Date of Patent: Jun. 6, 1989

[54] METHOD OF ENHANCING THE LEACHING RATE OF A GIVEN MATERIAL

[75] Inventor: Keerthi Devendra, Bristol, England

[73] Assignee: Rolls-Royce plc, London, England

[21] Appl. No.: 137,527

[22] Filed: Dec. 23, 1987

[30] Foreign Application Priority Data

Jan. 17, 1987 [GB] United Kingdom ..... 8700968

[51] Int. Cl.[4] ..... B22D 29/00

[52] U.S. Cl. ..... 164/132; 164/369; 156/628; 156/655; 156/664; 156/667

[58] Field of Search ..... 156/628, 655, 664, 667; 65/22, 31, 3.15, DIG. 16; 164/131, 132, 369, 529; 264/221, 317; 501/84

[56] References Cited

U.S. PATENT DOCUMENTS

| | | | |
|---|---|---|---|
| 3,218,684 | 11/1965 | Spink | 164/132 |
| 3,549,736 | 12/1970 | Waugh . | |
| 3,563,711 | 2/1971 | Hammond et al. | 164/132 |
| 3,743,692 | 7/1973 | Vinton et al. | 164/132 |
| 4,156,614 | 5/1979 | Greskovich et al. | 164/132 |
| 4,547,233 | 10/1985 | Delzant | 65/31 |
| 4,556,096 | 12/1985 | Nagata et al. | 164/132 |
| 4,640,699 | 2/1987 | Ohmi et al. | 65/31 |
| 4,670,033 | 6/1987 | Miura | 65/31 |
| 4,707,312 | 11/1987 | Bajaj | 501/84 |
| 4,721,549 | 1/1988 | Bogenschutz et al. | 65/31 |
| 4,777,154 | 10/1988 | Torobin | 501/84 |

FOREIGN PATENT DOCUMENTS

| | | |
|---|---|---|
| 1279096 | 6/1972 | United Kingdom . |
| 1279628 | 6/1972 | United Kingdom . |
| 1281684 | 7/1972 | United Kingdom . |

*Primary Examiner*—Kenneth M. Schor
*Assistant Examiner*—L. Johnson
*Attorney, Agent, or Firm*—Oliff & Berridge

[57] ABSTRACT

This invention relates to a method of enhancing the leaching rate of a given material. The material is provided with a plurality of pores 16 each of which contain a gas, such as for example air, which is intermittantly exposed to the leaching solution 20 by the action of said leaching solution and acts to promote the rapid removal of the reaction product away from the core/leading solution interface 22.

2 Claims, 1 Drawing Sheet

METHOD OF ENHANCING THE LEACHING RATE OF A GIVEN MATERIAL

BACKGROUND OF THE INVENTION

1. Field of the Invention

The present invention relates to an apparatus and method of enhancing the leaching rate of a given material, and is particularly relevant to enhancing the leaching rate of ceramic materials used as cores in the production of cast components.

2. Related Art Statement

Ceramic cores and/or tubes are used to produce intricate cooling paths in, for example, turbine blades. After the casting operation has taken place, the cores are removed by dissolving them in a leaching solution.

At present, there aere basically two types of core material, namely: those having a fully dense structure and those having a structure of interconnecting pores.

During the leaching process, core material is gradually dissolved at the core/solution interface and the reaction product is transported away from the interface by diffusion into the leaching solution. This leads to a concentration gradient of the reaction product within the leaching solution, the concentration being highest near the interface.

Under the conditions outlined above, the leaching rate of a core is determined entirely by the rate of diffusion of the reaction product from the interface to the bulk of the leaching solution.

If, however, the leaching solution is agitated the removal rate of the reaction product can be increased, thus making the leaching rate less dependent on the diffusion of the reaction product through the solution. However, in the case of thin cores or small diameter tubes, after the removal of the first few millimeters of the material, any agitation in the bulk of the leaching solution would have little or no effect on the reaction product at the core/solution interface. This means that the leaching rate would again be dependent on the rate at which the reaction product can diffuse into the bulk of the leaching solution, which is situated some distance away from the core/solution interface. The rate of leaching will gradually decrease with time as the depth of the cavity left by the removal of the core increases.

SUMMARY OF THE INVENTION

The present invention attempts to overcome the problems associated with the above mentioned method of leaching by providing a core material which acts to increase the rate of diffusion of the reaction product into the bulk of the leaching solution. The present invention will now be more particularly described by way of example only with reference to the following drawings, in which:

DETAILED DESCRIPTION OF THE DRAWINGS

Figure 1:
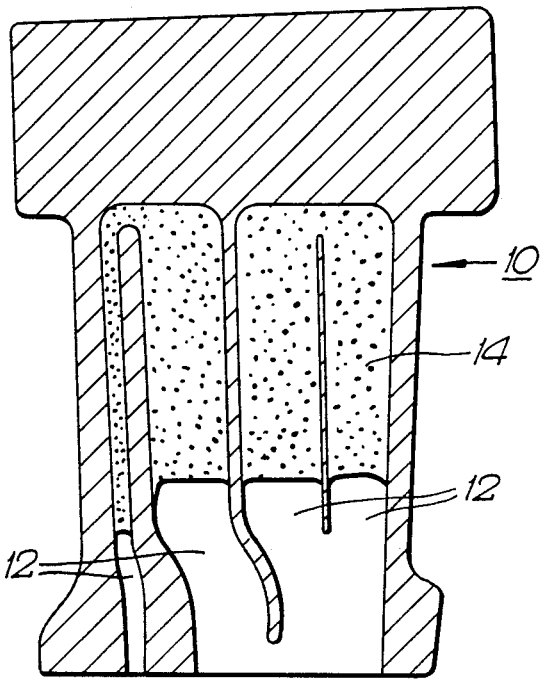
FIG. 1 is a cross sectional view of a cast turbine blade having a partially leached core.
Figure 2:
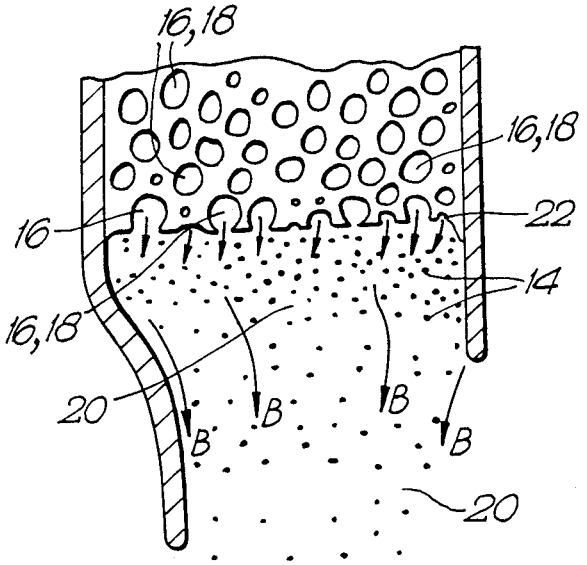
FIG. 2 is an exploded view of the core at the core/solution interface.

Referring to FIG. 1, a turbine blade 10 is provided with a number of internal passages, shown generally at 12, which the core 14 acts to define during the casting process. The core 14, best seen in FIG. 2, comprises a leachable material having a closed cellular construction formed by a plurality of pores, shown generally at 16. Each pore acts to trap a supply of gas 18 inside the core 14.

In operation, the leaching solution 20 breaks down the core material and intermittantly expose the pores 16. When released, the gas 18 contained within the pores 16, acts to push the reaction product away from the interface 22 and promote its rapid removal in the direction of arrows B towards the bulk of the leaching solution. The action of the gas 18 allows fresh leaching solution 20 to reach the reaction interface 22, hence enhancing the leaching rate.

In order to maintain the same physical and chemical properties of the previously known cores 14, it is preferable that the core is constructed having a large number of fine, closed pores 16 each of which has a supply of trapped gas 18.

It will be appreciated that if the core material 14 has interconnected porosity, these pores 16 would generally be filled with the leaching solution 20 in a comparatively short period of time and would not enhance the leaching rate. However, such a porous material may be soaked in a colloidal suspension of silica, alumina or zirconia or any other suitable material, which when refired at a suitable temperature would cause some of the interconnected pores to be blocked.

Hence, the filling of all the pores with leaching solution would be prevented.

The cores 14 may be produced from any leachable material, such as for example alumina ($Al_2O_3$), or zirconia, silica, etc.

I claim:

1. A method of enhancing the leaching rate of a core for use in casting articles having intricate internal voids, comprising:

providing a leachable core consisting essentially of a plurality of closed cellular pores each having a gas contained therein; and releasing said gas into a leaching solution at a leaching solution/core interface, such that the leaching solution proximate said leaching solution/core interface is agitated, thereby enhancing the leaching rate of said core wherein the agitation provides diffusion of a leaching reaction product into the bulk of the leaching solution and the introduction of fresh leaching solution to the solution/core interface.

2. A method according to claim 1, wherein said gas is released into said leaching solution by an action of the leaching solution dissolving the core.

* * * * *